US010550855B2

(12) United States Patent
Arai et al.

(10) Patent No.: US 10,550,855 B2
(45) Date of Patent: Feb. 4, 2020

(54) AXIAL FLOW FAN

(71) Applicant: MITSUBISHI ELECTRIC CORPORATION, Tokyo (JP)

(72) Inventors: Toshikatsu Arai, Tokyo (JP); Tomoya Fukui, Tokyo (JP); Hitoshi Kikuchi, Tokyo (JP); Tsutomu Takahashi, Tokyo (JP); Tatsushi Murakami, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 450 days.

(21) Appl. No.: 15/117,237

(22) PCT Filed: Feb. 14, 2014

(86) PCT No.: PCT/JP2014/053549
§ 371 (c)(1),
(2) Date: Aug. 8, 2016

(87) PCT Pub. No.: WO2015/121989
PCT Pub. Date: Aug. 20, 2015

(65) Prior Publication Data

US 2016/0348699 A1 Dec. 1, 2016

(51) Int. Cl.
*F04D 29/66* (2006.01)
*F04D 19/00* (2006.01)
(Continued)

(52) U.S. Cl.
CPC ..... *F04D 29/666* (2013.01); *F04D 19/002* (2013.01); *F04D 25/08* (2013.01);
(Continued)

(58) Field of Classification Search
None
See application file for complete search history.

(56) References Cited

U.S. PATENT DOCUMENTS 4,482,302 A * 11/1984 Grignon ..... F04D 29/023 415/220
6,994,523 B2 * 2/2006 Eguchi ..... F04D 29/384 416/228
(Continued)

FOREIGN PATENT DOCUMENTS

CN 102893034 A 1/2013
JP S57-069995 U 4/1982
(Continued)

OTHER PUBLICATIONS

Office Action (The First Office Action) dated Dec. 19, 2017, by the State Intellectual Property Office of the People's Republic of China in corresponding Chinese Patent Application No. 201480075403.0, and an English Translation of the Office Action. (13 pages).
(Continued)

*Primary Examiner* — Igor Kershteyn
*Assistant Examiner* — Juan G Flores
(74) *Attorney, Agent, or Firm* — Buchanan Ingersoll & Rooney PC

(57) ABSTRACT

An axial flow fan has a boss portion rotationally driven by a motor; a plurality of rotary blades extending radially from a periphery of the boss portion and configured to force air to flow in a direction of a rotation axis of the motor; and a bellmouth accommodating the plurality of rotary blades, the bellmouth comprising a suction-side round portion having a curved surface expanded in a radial direction of the bellmouth, and a discharge-side round portion having a curved surface expanded in the radial direction of the bellmouth, the plurality of rotary blades each being entirely inclined to have an outer peripheral portion in a downstream side in an airflow direction, entirety of the outer peripheral portion being located on the downstream side in the air flow direction with respect to the suction-side round portion.

7 Claims, 8 Drawing Sheets

(51) Int. Cl.

| | |
|---|---|
| ***F04D 29/38*** | (2006.01) |
| ***F04D 29/52*** | (2006.01) |
| ***F04D 25/08*** | (2006.01) |
| ***F04D 29/32*** | (2006.01) |

(52) U.S. Cl.
CPC ..... *F04D 29/325* (2013.01); *F04D 29/384* (2013.01); *F04D 29/526* (2013.01)

(56) References Cited

U.S. PATENT DOCUMENTS

| | | | | |
|---|---|---|---|---|
| 9,394,911 | B2 * | 7/2016 | Nakashima ..... | F04D 29/384 |
| 2010/0269537 | A1 | 10/2010 | Tadokoro et al. | |
| 2013/0101420 | A1 | 4/2013 | Nakashima et al. | |
| 2013/0136591 | A1 | 5/2013 | Yen et al. | |

FOREIGN PATENT DOCUMENTS

| | | | | |
|---|---|---|---|---|
| JP | S-62-169295 | U | 10/1987 | |
| JP | H-06-229398 | A | 8/1994 | |
| JP | 2560793 | B2 | 12/1996 | |
| JP | 2002-257096 | A | 9/2002 | |
| JP | 3744489 | B2 | 2/2006 | |
| JP | 4818310 | B2 | 11/2011 | |
| JP | WO 2011141964 | A1 * | 11/2011 | ..... F04D 29/384 |
| JP | 2013-113128 | A | 6/2013 | |
| WO | WO 2009/113338 | A1 | 9/2009 | |
| WO | WO 2011/141964 | A1 | 11/2011 | |

OTHER PUBLICATIONS

Office Action (Notice of Reasons for Rejection) dated Jan. 17, 2017, by the Japanese Patent Office in corresponding Japanese Patent Application No. 2015-562656, and an English Translation of the Office Action. (6 pages).

Office Action (Notice of Reasons for Rejection) dated Apr. 11, 2017, by the Japanese Patent Office in corresponding Japanese Patent Application No. 2015-562656 and English translation of the Office Action. (6 pages).

Office Action dated Aug. 29, 2018, by the Chinese Patent Office in corresponding Chinese Patent Application No. 201480075403.0 and English translation of the Office Action. (13 pages).

Office Action dated Mar. 21, 2019, by the Chinese Patent Office in corresponding Chinese Patent Application No. 201480075403.0 and English translation of the Office Action. (9 pages).

International Search Report (PCT/ISA/210) dated May 13, 2014, by the Japanese Patent Office as the International Searching Authority for International Application No. PCT/JP2014/053549.

* cited by examiner

AXIAL FLOW FAN

TECHNICAL FIELD

The present invention relates to an axial flow fan to be used for a ventilation fan, an air-conditioning apparatus, a cooling fan, or other devices.

BACKGROUND ART

Known rotary blades (sometimes referred to as rotary vanes) for an axial flow fan are shaped to be swept forward in a rotation direction and inclined forward to a suction side to reduce noise. With such rotary blades, a shape of a bellmouth has been employed that is semi-open to overlap portions of the rotary blades at trailing edges thereof (hereinafter referred to as a "semi-open bellmouth"). Reducing noise has been thus achieved by configuring the shape of the bellmouth or the positional relationship between the blades and the bellmouth.

To further reduce the noise, a shape of the rotary blade has been recently proposed that can reduce interference caused by a blade tip vortex. In one such proposed shape, the blade is bent toward an upstream side of a flow of air at a blade outer peripheral portion of the blade. This is to address a leakage flow around the blade outer peripheral portion from the pressure surface side to the suction surface side, and a blade tip vortex generated on the blade suction surface. The leakage flow is generated when the blade is rotated due to a pressure difference between a pressure surface and a suction surface of the rotary blade, and the blade tip vortex is generated due to this leakage flow. Interference of the leakage flow and the blade tip vortex with a vane surface, an adjacent blade, and the bellmouth is a cause of increased noise.

An axial flow fan to be used for a ventilation fan, an air-conditioning apparatus, a cooling fan, or other devices, is rarely equipped solely with rotary blades; a bellmouth is arranged around the rotary blades to rectify a flow and increase a pressure. Therefore, not only the rotary blade is relevant to air blowing and noise characteristics, but also do the other factors, such as the shape of the bellmouth, the positional relationship between the rotary blades and the bellmouth.

A known axial flow fan includes a propeller fan having a plurality of blades formed on an outer periphery of a hub, and a fan guide. A dihedral angle on a mean flow surface of the blade is set to approximately 60 degrees. The fan guide is formed into a tubular shape, and a length of the fan guide in an axial direction is set to 0.8H or more of a height H of the blade. A suction-side end portion of the fan guide is shifted toward a discharge side from suction-side end portions of the blades, and an amount U of the shift is set to satisfy a relationship of $0.3H \leq U \leq 0.5H$ (see, for example, Patent Literature 1).

Further, there is known an axial flow fan including a propeller fan configured to be rotated by a drive source, a tubular air introducing portion covering the propeller fan while securing a predetermined size of space behind the propeller fan, and a shroud formed continuously to the air introducing portion to be opened on a front side of the propeller fan so as to introduce air in a wide range on the front side of the propeller fan to the air introducing portion. The opening portion of the shroud is obliquely shaped and narrowed to the air introducing portion. Each of the blades of the propeller fan is formed in such an inclined manner as to be swept forward in a rotation direction, whereas a leading edge portion of each of the blades formed to be approximately perpendicular to the rotation axis of the propeller fan. A forward end side of the propeller fan in the direction of the rotation axis is arranged to be swept forward from a boundary between the air introducing portion and the opening portion toward the opening portion by a predetermined amount (see, for example, Patent Literature 2).

Further, there is known a blower device including a propeller fan having a plurality of blades being formed on an outer peripheral surface of a hub as a rotation center and each having a thick blade shape as typified by an airfoil blade, a bellmouth being located on a radially outer side with respect to the propeller fan and partitioning a suction region and a discharge region, and a fan guard located on a discharge side with respect to the propeller fan. The bellmouth includes a suction-side arc portion located on a suction side, a discharge-side arc portion located on the discharge side, and a cylindrical portion located between the discharge-side arc portion and the suction-side arc portion. When a height of the bellmouth in an axial direction at a portion overlapping with an outer peripheral portion of each of the blades is represented by H1, and a height of the outer peripheral portion of each of the blades is represented by H0, those parameters are set so as to fall within a range of $H1/H0=0.40$ to 0.65 (see, for example, Patent Literature 3).

As disclosed in Patent Literatures 1 to 3, as for the related-art rotary blades, consideration is made on the axial flow fan including the semi-open bellmouth that overlaps with the bellmouth in a range from the chord center to the blade trailing edge, and the axial flow fan constructed such that most part of each of the rotary blades is accommodated in a bellmouth air channel.

Further, as for the propeller fan having the shape in which the blade outer peripheral portion is bent in the upstream direction of the flow of air, an optimal positional relationship between the rotary blades and the bellmouth is proposed as well as a shape of the bellmouth.

For example, there is known an axial flow fan including a hub being a rotation center, a plurality of vanes being formed on an outer peripheral surface of the hub so that outer peripheral ends of a leading edge and a trailing edge are located on a front side in a rotation direction, and a bellmouth being arranged so as to surround outer peripheries of the plurality of vanes and including an air inlet-side first round surface portion, a cylindrical portion having a predetermined width and being located on a downstream side with respect to the inlet-side first round surface portion, and an air outlet-side second round surface portion located on a downstream side with respect to the cylindrical portion. An outer peripheral end portion of each of the vanes is inclined toward the air inlet-side. The outer peripheral end of the inclined trailing edge portion of each of the vanes is located at an air outlet-side end portion of the cylindrical portion of the bellmouth. The trailing edge portion of each of the vanes at a part other than the inclined part is located at an air outlet-side end portion of the second round surface portion of the bellmouth (see, for example, Patent Literature 4).

Further, in order to obtain an axial flow fan in which blade outer peripheral portions are each bent in an upstream direction of a flow of air and most part of each of blades is accommodated in a bellmouth air channel, and in which noise caused by a blade tip vortex is small and the degree of decrease in air blowing performance is small, there is also proposed an axial flow fan including a bellmouth air channel gradually reduced in diameter from a large-diameter air inlet side to an air outlet side, in which most part of each of the blades is accommodated in the bellmouth air channel (see, for example, Patent Literature 5).

Further, there is also proposed an axial flow fan including a boss configured to be rotated about an axial center, and a plurality of rotary blades arranged on an outer peripheral portion of the boss. The rotary blades are each formed so that a chord center line connecting chord center points from an inner peripheral end to an outer peripheral end of the rotary blade is curved to protrude toward a downstream side of a flow of air in an entire region of the rotary blade in a radial direction (see, for example, Patent Literature 6).

CITATION LIST

Patent Literature

Patent Literature 1: Japanese Utility Model Application Publication No. Sho 62-169295

Patent Literature 2: Japanese Patent No. 2560793

Patent Literature 3: Japanese Unexamined Patent Application Publication No. 2002-257096

Patent Literature 4: Japanese Patent No. 3744489

Patent Literature 5: Japanese Patent No. 4818310

Patent Literature 6: International Patent WO 2011/141964 A1

SUMMARY OF INVENTION

Technical Problem

In the axial flow fan to be used for ventilation, an outdoor unit of the air-conditioning apparatus, or so, to attain the noise reduction as the main purpose, the rotary blades are each formed into the shape swept forward and inclined forward, and the blade outer peripheral portions are each formed into the shape bent toward the upstream side of the flow of air. Further, the semi-open bellmouth type is employed (for example, Patent Literatures 1 to 4).

Further, the bellmouth shape is also optimized so as to reduce noise in the type of the axial flow fan in which the rotary blades are each formed into the shape swept forward and inclined forward, and the blade outer peripheral portions are each formed into the shape bent toward the upstream side of the flow of air so that most part of each of the rotary blades is accommodated in the bellmouth (for example, Patent Literature 5).

On the other hand, in the axial flow fan to be used, for example, for the cooling fan to be built into a device, it is important to obtain a necessary air flow rate, static pressure, and noise characteristic while reducing the product height and the area for installation of the product so as to restrict the size of the device into which the axial flow fan is assembled, and to avoid interference with other components. However, the optimal shapes as in the above-mentioned patent literatures cannot be applied as the bellmouth shape required for reducing noise of the axial flow fan in many cases. Thus, there is a problem of the deterioration of the air blowing and noise characteristics.

The present invention has been made to overcome the above-mentioned problem, and has an object to provide an axial flow fan in which rotary blades are accommodated in a bellmouth and that can reduce deterioration of air blowing and noise characteristics.

Solution to Problem

In order to solve the above-mentioned problem to attain the object, the present invention employs the following configuration. Specifically, there is provided an axial flow fan, comprising: a boss portion rotationally driven by a motor; a plurality of rotary blades each extending radially from a periphery of the boss portion and being configured to force air to flow in an airflow direction being a direction of a rotation axis of the motor; and a bellmouth accommodating the plurality of rotary blades, the bellmouth comprising a suction-side round portion being formed on a suction side of the bellmouth and having a curved surface expanded in a radial direction of the bellmouth and a discharge-side round portion being formed on a discharge side of the bellmouth and having a curved surface expanded in the radial direction of the bellmouth, the plurality of rotary blades each being entirely inclined to have an outer peripheral portion of each of the plurality of rotary blades in a downstream side in an airflow direction, entirety of the outer peripheral portion being located on the downstream side in the air flow direction with respect to the suction-side round portion.

Advantageous Effects of Invention

According to the present invention, in the axial flow fan constructed such that the entire outer peripheral portion of each of the rotary blades is accommodated in the bellmouth portion, the rotary blades each entirely inclined in the downstream direction of the flow of airflow of air to be blown as approaching to the outer peripheral portion of each of the blades, that is, the rotary blades each inclined backward are employed, and the positional relationship between the outer peripheral-side leading end portion of each of the rotary blades and the bellmouth suction portion is optimized. Thus, there is attained an effect of obtaining a blower device reduced in noise that may be caused by turbulence generated in the bellmouth suction portion and less reduced in air blowing performance.

Further, thinning of the axial flow fan in the axial direction of the motor can be realized.

DESCRIPTION OF EMBODIMENTS

Figure 1:
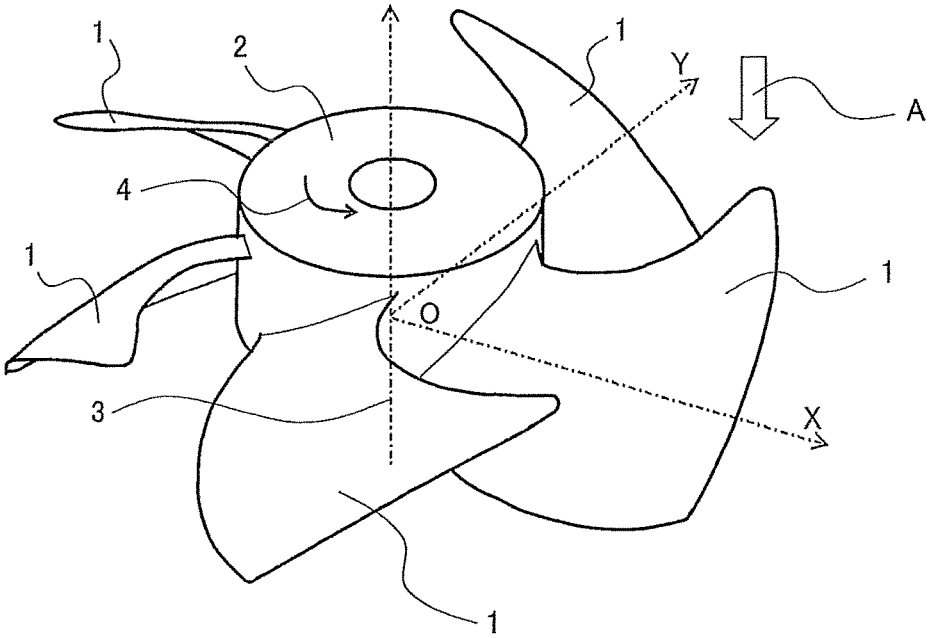
FIG. 1 is a perspective view illustrating rotary blades of an axial flow fan according to an embodiment of the present invention.

Now, an axial flow fan according to an embodiment of the present invention is described in detail referring to the drawings. Note that, the present invention is not limited by this embodiment.

Embodiment

FIG. 1 is a perspective view illustrating rotary blades 1 of the axial flow fan according to the embodiment of the present invention. As illustrated in FIG. 1, five rotary blades 1 are provided in the embodiment, but the number of the rotary blades 1 is not limited to five. In the following description for the rotary blades 1 of this embodiment, a shape of a single rotary blade is mainly described, but shapes of the other rotary blades are the same as the described one.

The rotary blades 1 each having a three-dimensional shape, which are illustrated in FIG. 1, are configured to be rotationally driven by a motor (not shown) in this case, and are mounted to extend radially on an outer periphery of a boss portion 2 having a columnar shape, which is configured to rotate about a rotation axis 3 in a direction indicated by the arrow 4. Through the rotation of the rotary blades 1, a flow of air (flow of air to be blown) flowing in a direction indicated by the arrow A is generated. An upstream side of the rotary blade 1 corresponds to a suction surface, and a downstream side thereof corresponds to a pressure surface.

Figure 2:
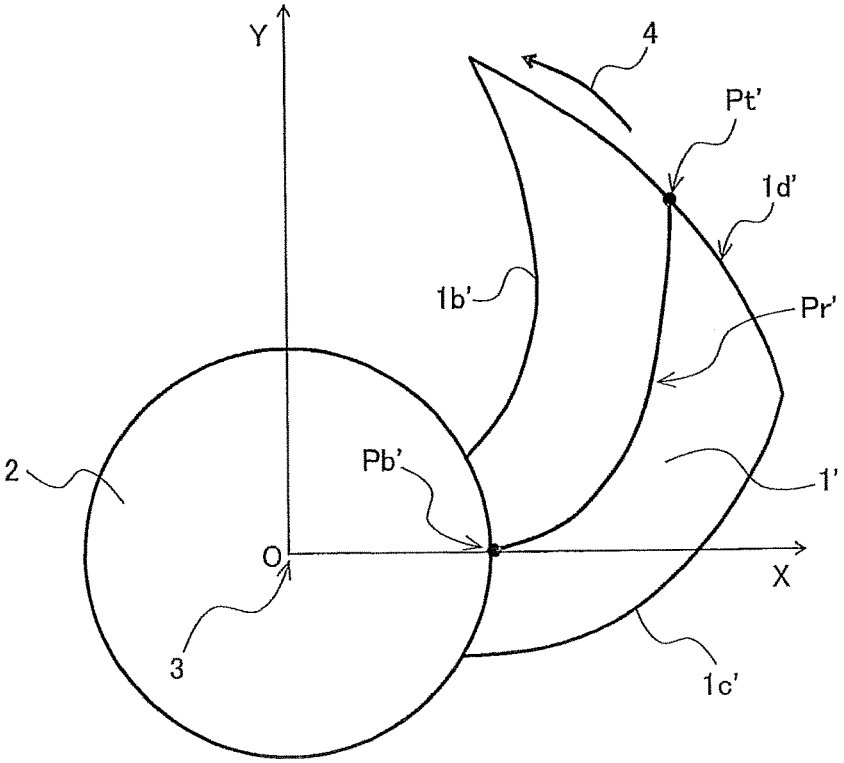
FIG. 2 is a projection plan view illustrating a state in which the rotary blade illustrated in FIG. 1 is projected on a plane perpendicular to a rotation axis.

FIG. 2 is a projection plan view for illustrating a state in which the rotary blade 1 illustrated in FIG. 1 is projected on a plane perpendicular to the rotation axis 3. When the rotary blade 1 illustrated in FIG. 1 is projected on a plane Sc perpendicular to the rotation axis 3 (see FIG. 3), a shape of a rotary blade 1' illustrated in FIG. 2 is obtained. A point Pb' illustrated in FIG. 2 indicates a center point (middle point) of a chord on the outer periphery of the boss portion 2, the chord regarded as extending from a blade leading-edge portion 1*b*' to a blade trailing-edge portion 1*c*'. Further, reference symbol "O" in FIG. 1 and FIG. 2 indicates the center of the rotary blades.

Figure 3:
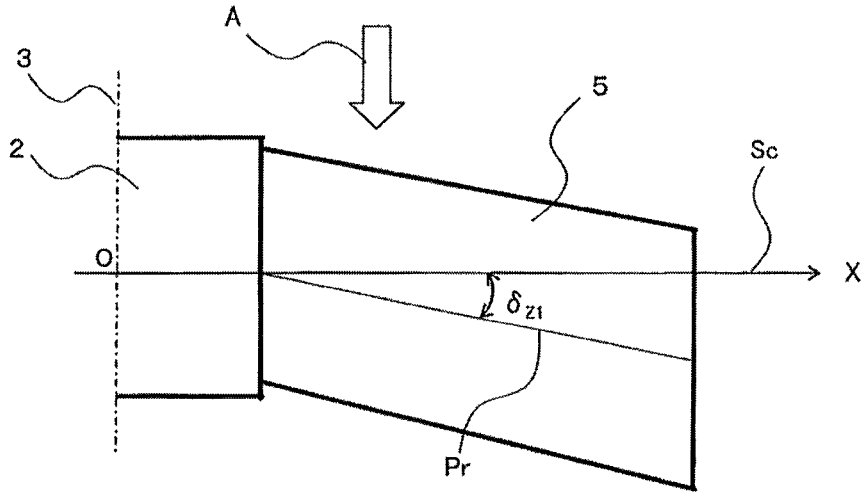
FIG. 3 is a schematic view of a rotary blade, which is obtained by rotationally projecting the rotary blade illustrated in FIG. 2 on a perpendicular plane including the rotation axis and an OX axis, is inclined backward.

FIG. 3 is a schematic view of a rotary blade 5 obtained by rotationally projecting the rotary blade 1' illustrated in FIG. 2 on a perpendicular plane including the rotation axis 3 and an OX axis. Therefore, reference symbols 1, 1', and 5 indicate the same rotary blade. As illustrated in FIG. 3, the rotary blade 5 is inclined to have an outer peripheral portion, located away from the boss portion 2, of the rotary blade 5, is located more toward a direction corresponding to a direction A of the flow of air than the boss 5. That is, the rotary blade 5 is inclined backward with respect to a direction from an upstream side toward a downstream side of the flow of air.

Figure 4:
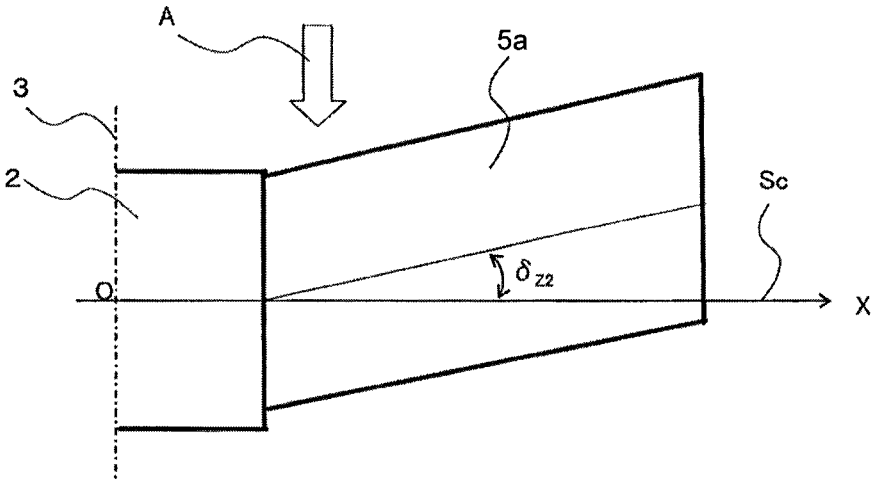
FIG. 4 is a schematic view corresponding to FIG. 3, for illustrating a related-art axial flow fan in which the rotary blade is inclined forward.

FIG. 4 is a schematic view of a related-art rotary blade 5*a* inclined forward for comparison with the rotary blade 5 of this embodiment. As illustrated in FIG. 4, the related-art rotary blade 5*a* is inclined to have the outer peripheral portion, located away from the boss portion 2 of the rotary blade 5, is located more toward the direction inverse to the direction A of the flow of air than the boss 5. That is, the rotary blade 5*a* is inclined forward with respect to the direction from the downstream side toward the upstream side of the flow of air.

Next, description is given of the axial flow fan in which the rotary blade 5 inclined backward according to this embodiment, which is illustrated in FIG. 3, is accommodated in a bellmouth 6. In the following, description is given of an example of an axial flow fan in which a blade outer peripheral portion of the rotary blade (1, 1', 5) defined in the above-mentioned manner is accommodated in the bellmouth 6.

Figure 5:
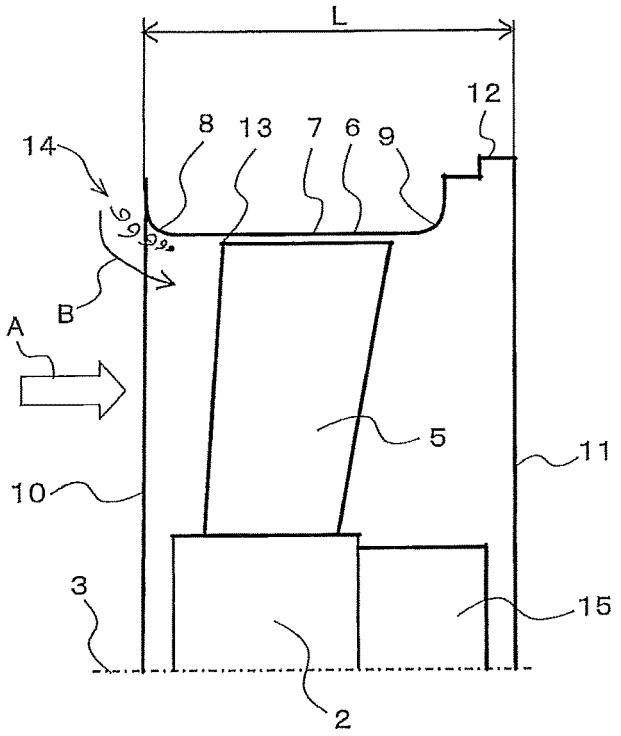
FIG. 5 is a view illustrating a positional relationship between the rotary blade and a bellmouth according to the embodiment of the present invention.

In FIG. 5, the rotary blade 5 inclined backward is rotated, thereby generating a flow of air in the direction indicated by the arrow A. In this case, a flow of air B flows into an outer peripheral-side leading end portion 13 of the rotary blade 5 along a bellmouth suction-side round portion 8. Note that, the bellmouth suction-side round portion 8 corresponds to a curved surface-like portion of the bellmouth 6, which is formed on a suction side of the bellmouth 6 to expand in a radial direction of the bellmouth. When the bellmouth suction-side round portion 8 is small or a flow velocity of the flow of air B flowing into the outer peripheral-side leading end portion 13 is high, turbulence indicated by reference symbol 14 is generated in the flow of air B. Suction of this turbulence 14 by the rotary blade 5 leads to deterioration of air blowing and noise characteristics.

Further, when dimensions of an outer shell of a product are reduced or a height of the product is reduced along with downsizing of the product, the bellmouth suction-side round portion 8, a bellmouth straight portion 7, or a bellmouth discharge-side round portion 9 are downsized. Therefore, the rotary blade 5 is liable to suck the turbulence indicated by reference symbol 14, thus leading to the deterioration of the air blowing and noise characteristics.

Note that, the bellmouth discharge-side round portion 9 corresponds to a curved surface-like portion of the bellmouth 6, which is formed on a discharge side to expand in the radial direction of the bellmouth, and the bellmouth straight portion 7 corresponds to a smooth portion located between the bellmouth suction-side round portion 8 and the bellmouth discharge-side round portion 9 and connecting the bellmouth suction-side round portion 8 and the bellmouth discharge-side round portion 9 to each other.

In view of the above, as illustrated in FIG. 5, the outer peripheral-side leading end portion 13 of the rotary blade 5 inclined backward is arranged so as to be located on the downstream side with respect to the bellmouth suction-side round portion 8. With this, even when the bellmouth suction-side round portion 8 is small or the flow velocity of the flow of air B flowing into the outer peripheral-side leading end portion 13 is high, the turbulence indicated by reference symbol 14 is attenuated, and then the air is sucked by the rotary blade 5, thereby being capable of reducing the deterioration of the air blowing and noise characteristics.

Further, a motor 15 is arranged on the downstream side of the flow of air with respect to the rotary blades 5, and the rotary blades 5 are each inclined backward to the downstream side. Therefore, in an axial direction of the motor 15 (flow direction of the flow of air), an end surface of the motor 15 on the upstream side can be located on the upstream side with respect to end surfaces of the rotary blades 5 on the downstream side. With this, the rotary blades 5 and the motor 15 can be partially overlapped with each other so that a product height L can be reduced to thin the axial flow fan.

Figure 6:
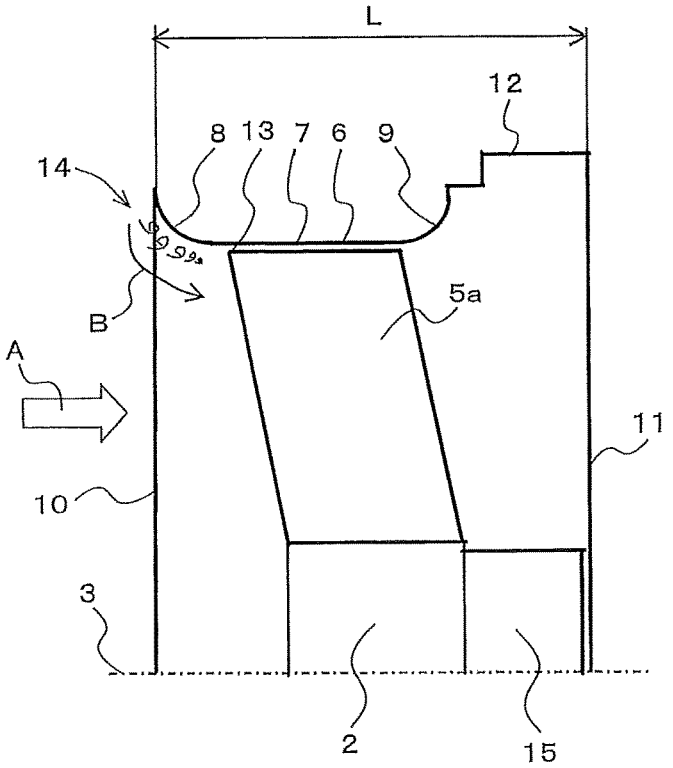
FIG. 6 is a reference view corresponding to FIG. 5, and illustrating the related-art axial flow fan in which the rotary blade is inclined forward.

FIG. 6 is a reference view of the related-art axial flow fan including the rotary blades 5*a* inclined forward. In this case, in order that the air is sucked by the rotary blades 5*a* after the turbulence indicated by reference symbol 14 is attenuated, a thickness dimension in the axial direction of the motor needs to be increased. That is, when the outer peripheral-side leading end portion 13 of the rotary blade 5*a* is located on the downstream side with respect to the bellmouth suction-side round portion 8 similarly to the case illustrated in FIG. 5, the motor 15 or auxiliary members such as legs (not shown) for holding the motor 15 are shifted toward the downstream side, and a product discharge-side end surface 11 is shifted toward the downstream side. Therefore, as a result, a dimension corresponding to the product height L (thickness dimension in the axial direction of the motor) is increased to thicken the axial flow fan.

Figure 7:
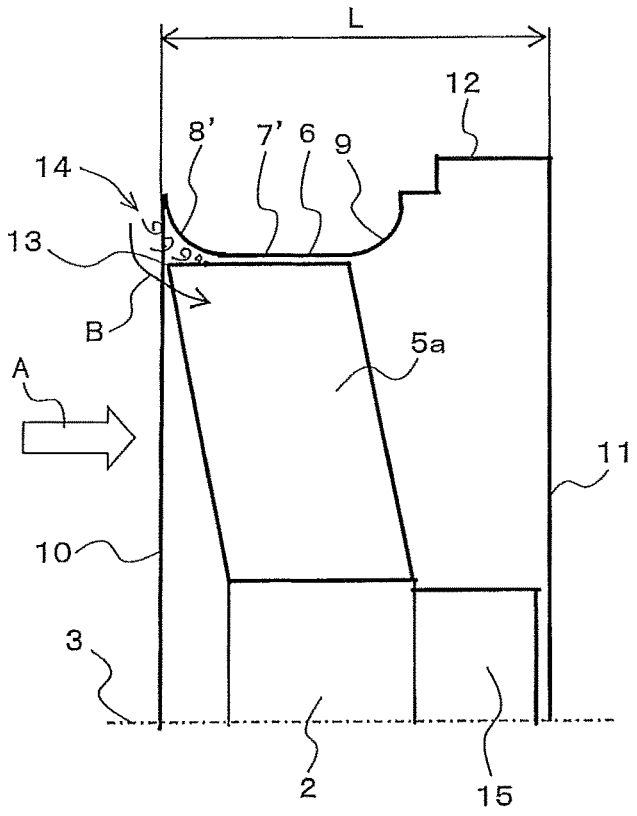
FIG. 7 is a referential drawing illustrating a related-art axial flow fan in which the rotary blade inclined forward is shifted from an optimal position to reduce a thickness of a product.

FIG. 7 is a reference view for illustrating a related-art axial flow fan in which the rotary blade 5*a* inclined forward is shifted from an optimal position toward the suction side to reduce the product thickness. In order to reduce the product height L without changing the rotary blade 5*a*, there are conceivable, for example, a method of downsizing a bellmouth suction-side round portion 8', a method of reducing a bellmouth straight portion 7' in length as in this example, and a method combining both the methods described above. However, in all of the methods, the outer peripheral-side leading end portion 13 of the rotary blade 5*a* may reach or come closer to the turbulence 14 passing through the bellmouth suction-side round portion 8'. As a result, the deterioration of the air blowing and noise characteristics is inevitable.

Figure 8:
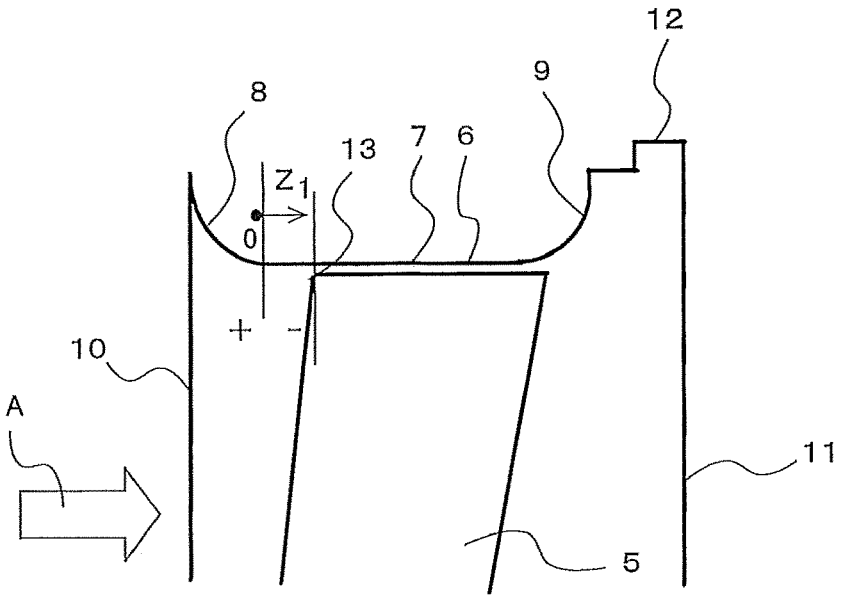
FIG. 8 is an enlarged view for illustrating a positional relationship between an outer peripheral portion of the rotary blade and a bellmouth suction-side round portion, which are illustrated in FIG. 5.

FIG. 8 is an enlarged view for illustrating a positional relationship between the outer peripheral portion of the rotary blade 5 and the bellmouth suction-side round portion, which are illustrated in FIG. 5.

Figure 9:
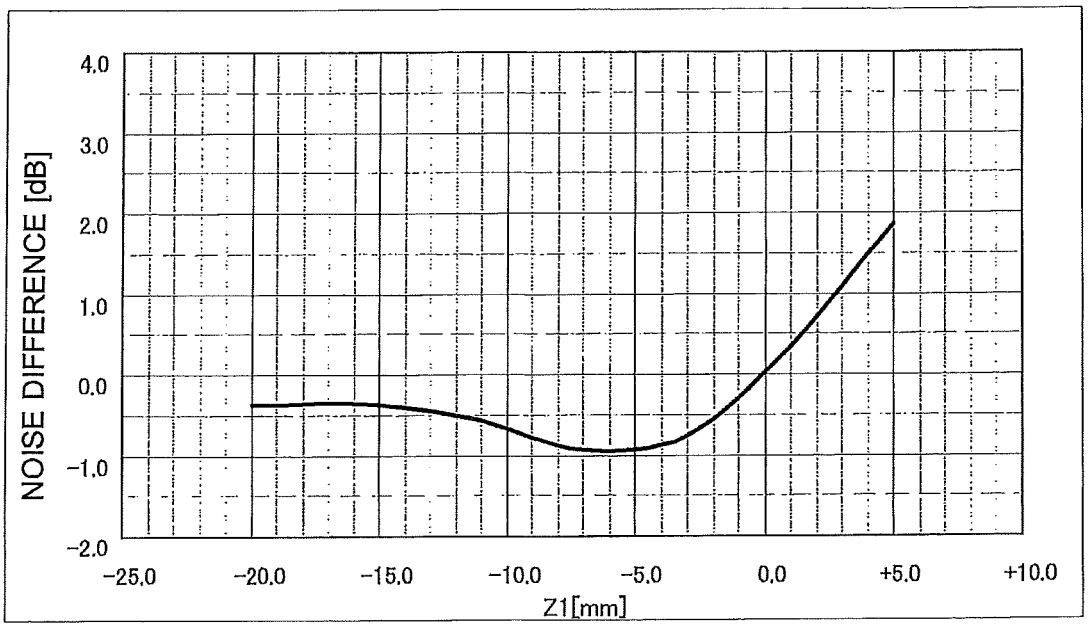
FIG. 9 is a graph showing change in noise when an outer peripheral-side leading end portion of the rotary blade is shifted in an axial direction under the state illustrated in FIG. 5 and FIG. 8.
Figure 10:
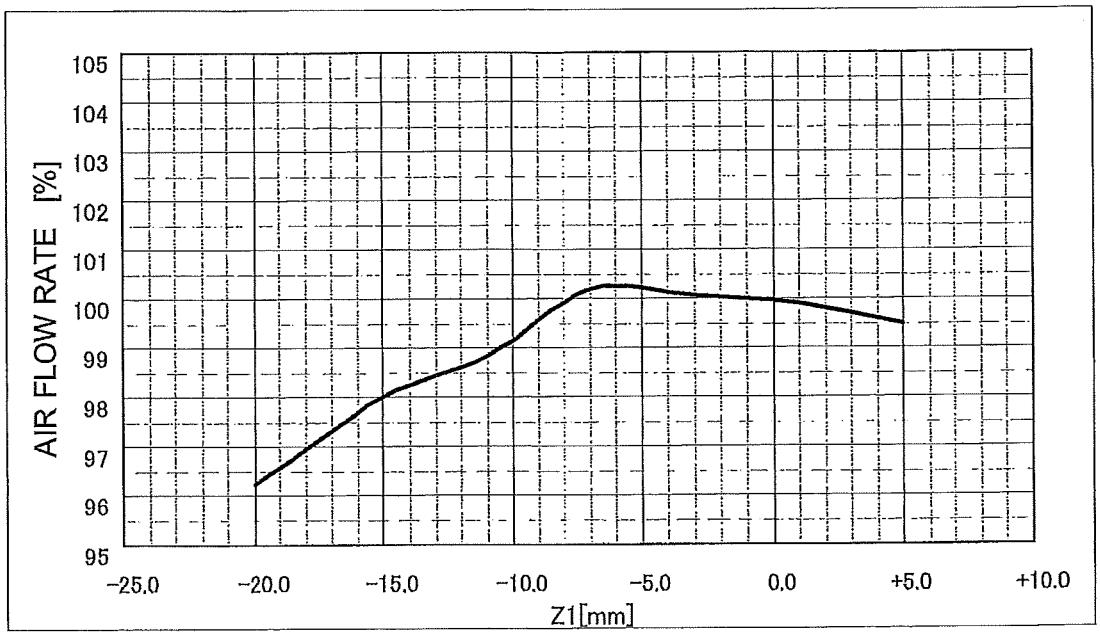
FIG. 10 is a graph showing change in air flow rate when the outer peripheral-side leading end portion of the rotary blade is shifted in the axial direction under the state illustrated in FIG. 5 and FIG. 8.

FIG. 9 is a graph for showing a relationship between noise and the positional relationship between the outer peripheral-side leading end portion 13 of the rotary blade 5 and the bellmouth suction-side round portion 8 under the state illustrated in FIG. 5 and FIG. 8. FIG. 10 is a graph for showing a relationship between an air flow rate and the positional relationship between the outer peripheral-side leading end portion 13 of the rotary blade 5 and the bellmouth suction-side round portion 8 under the state illustrated in FIG. 5 and FIG. 8). Note that, the air flow rate is measured at a point of static pressure=0.

Pieces of measured data in FIG. 9 and FIG. 10 are obtained by calculating results of air blowing and noise characteristics based on characteristics at a position of Z1=0 under a condition that the rotary blade 5 being inclined backward and having a diameter φ of 220 (mm) and a height of the blade outer peripheral portion of about 50 (mm) is used, a curvature radius of the bellmouth suction-side round portion 8 is 15.5 (mm), a length of the bellmouth straight portion 7 is 56 (mm), and a radius of the bellmouth discharge-side round portion is 15.5 (mm). Note that, an upstream side with respect to the position of Z1=0 in FIG. 8 corresponds to a +Z1 side in FIG. 9 and FIG. 10, and a downstream side with respect to the position of Z1=0 in FIG. 8 corresponds to a −Z1 side in FIG. 9 and FIG. 10.

In FIG. 9, a noise difference determined based on a noise value at Z1=0 is shown. It is understood from FIG. 9 that noise is significantly exacerbated as the rotary blade 5 approaches the upstream side with respect to the bellmouth suction-side round portion 8. Further, it is shown that the noise is minimized in the vicinity of Z1=−6 (mm), and when the rotary blade 5 is located on a downstream side with respect to the position of Z1=−6 (mm), the noise is slightly exacerbated, but the noise difference is approximately constant.

In FIG. 10, a percentage of the air flow rate determined based on a value of the air flow rate at Z1=0 is shown. It is understood from FIG. 10 that the air flow rate is slightly reduced as the rotary blade 5 approaches the upstream side with respect to the bellmouth suction-side round portion 8. Further, it is understood that the value of the air flow rate is maximized at approximately the same position as the position at which the noise is minimized as shown in FIG. 9. However, it is shown that the air flow rate is reduced when the rotary blade 5 is located on a downstream side with respect to that position.

It is shown from FIG. 9 and FIG. 10 that the arrangement in which the blade outer peripheral portion is located on the downstream side with respect to the bellmouth suction-side round portion 8, and is located at the bellmouth straight portion 7, is optimal in terms of the air blowing and noise characteristics.

Figure 15:
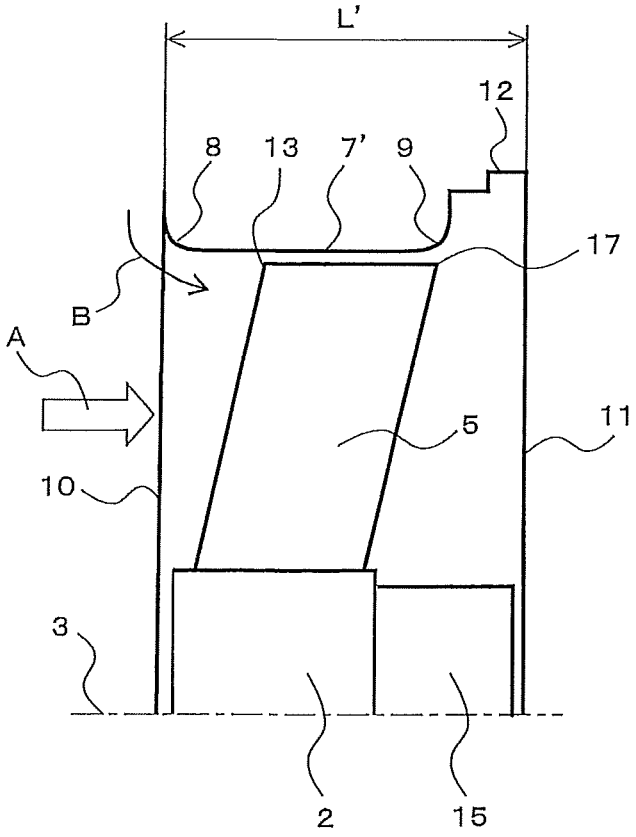
FIG. 15 is a view illustrating an example for further reducing a product height, specifically, a view for illustrating a state in which a bellmouth straight portion is reduced in length, and the positional relationship between the rotary blade and the bellmouth is modified.

Further, when further reduction in the product height L is demanded, and the product height is represented by L' as illustrated in FIG. 15, a bellmouth straight portion 7' reduced in length as compared to the bellmouth straight portion 7 is set. It is verified that an effect of the deterioration of the air blowing and noise characteristics can be reduced through arrangement in which an outer peripheral-side trailing edge portion 17 of the rotary blade protrudes toward the bellmouth discharge-side round portion 9 side with respect to the bellmouth straight portion 7'.

Figure 11:
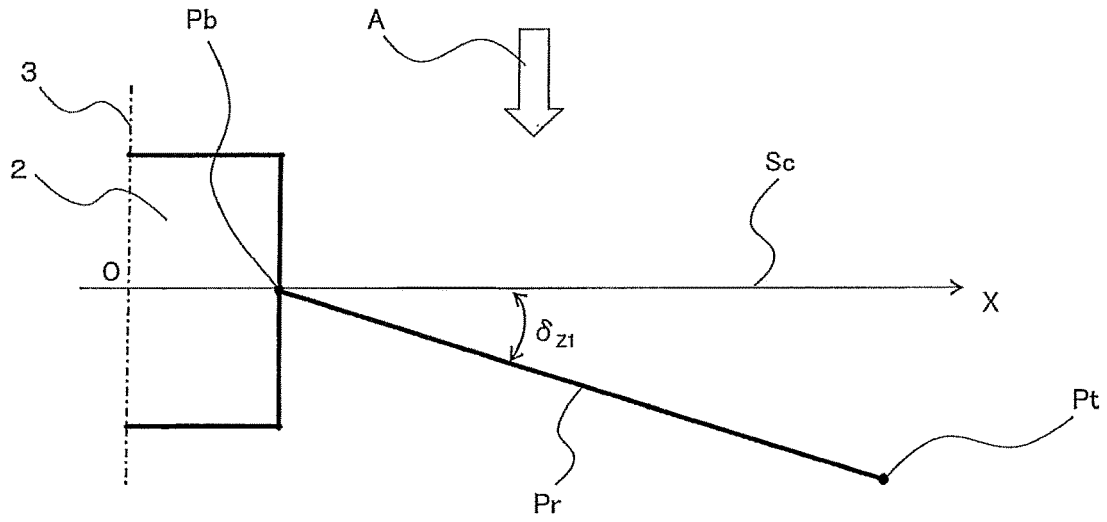
FIG. 11 is a view illustrating a chord center line of the rotary blade illustrated in FIG. 3.

FIG. 11 is a view illustrating a locus of chord center points Pr' in a range from the chord center point Pb' at the boss portion 2 in FIG. 2 to a chord center point Pt' at the blade outer peripheral portion. Specifically, FIG. 11 is a view illustrating a locus (chord center line) of chord center points Pr, obtained as revolved projection of the chord center points Pr' at an arbitrary radius R among the chord center points Pb'-Pr'-Pt' on a perpendicular plane including the rotation axis 3 and the OX axis at the radius R. The rotary blade 5 inclined backward is entirely inclined in the downstream direction of the flow of airflow of air to be blown as approaching to the outer peripheral portion of the rotary blade 5. Thus, the chord center line Pr is also inclined (inclined backward) in the flow direction as approaching to the blade outer peripheral side.

As illustrated in FIG. 11, the revolved projection of the chord center line Pr (locus of the chord center points Pr) onto the perpendicular plane including the rotation axis 3 and the OX axis is expressed as such a line that extends from the chord center point Pb at the boss portion 2 to the chord center point Pt at the outer peripheral-side leading end portion 13, and is inclined backward with a predetermined backward inclination angle δz1 with respect to a plane Sc perpendicular to the rotation axis 3.

Figure 12:
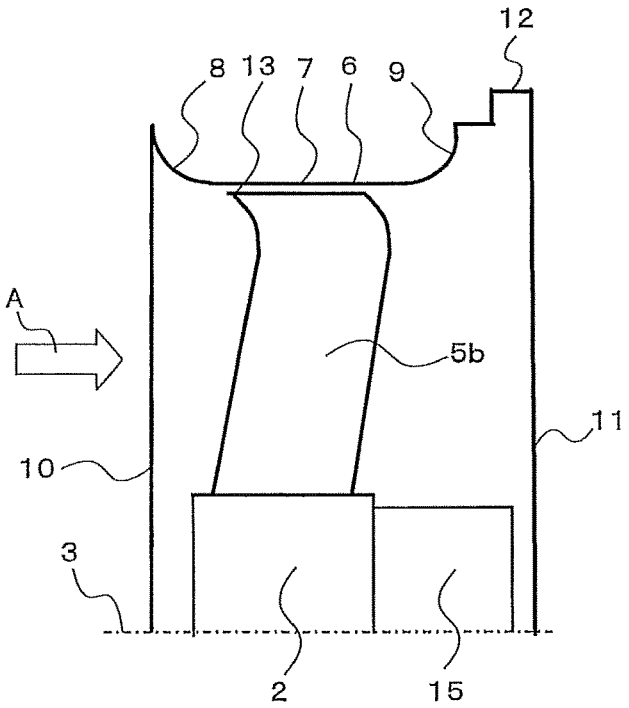
FIG. 12 is a view illustrating a second example of the embodiment, in which a blade outer peripheral portion of a rotary blade is bent toward an upstream side in a flow direction.

Next, a second example of this embodiment is described referring to FIG. 12. In FIG. 12, a rotary blade 5*b* having a blade outer peripheral portion bent toward the upstream side in the flow direction is applied in place of the rotary blades 5 in the state of FIG. 5.

Figure 13:
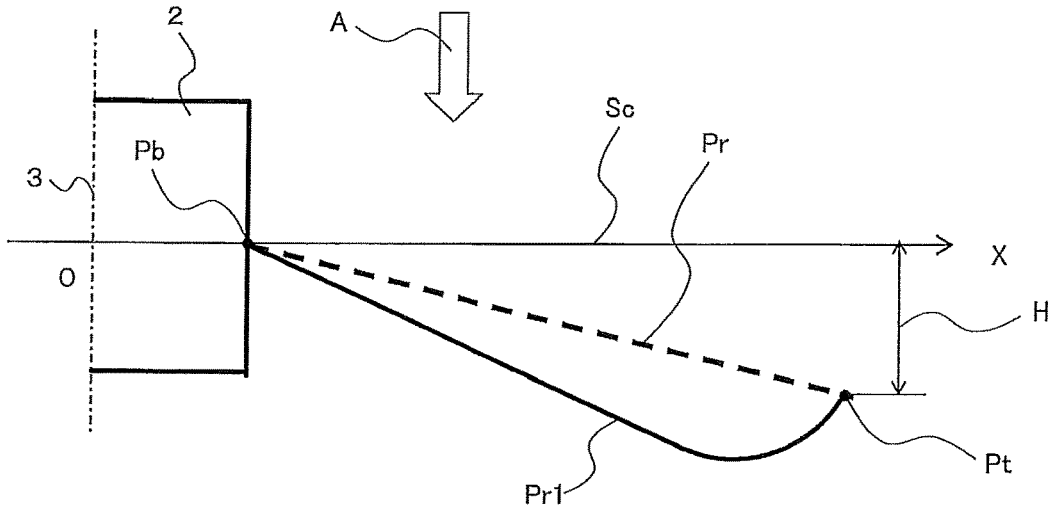
FIG. 13 is a view illustrating a chord center line of the rotary blade illustrated in FIG. 12.

FIG. 13 is a view for illustrating a chord center line of the rotary blade 5*b* illustrated in FIG. 12. A chord center line Pr1 of the rotary blade 5*b* having the blade outer peripheral portion bent toward the upstream side in the air flow direction is located on the downstream side with respect to the chord center line Pr having the constant backward inclination angle in a region from the chord center point Pb at the boss portion 2 to the chord center point Pt at the blade outer peripheral portion.

Note that, the broken line connecting Pb and Pt as illustrated in FIG. 13 corresponds to the locus of the chord center points Pr of the rotary blade 5 having the constant backward inclination angle δz1 as illustrated in FIG. 11.

On the chord center line Pr and the chord center line Pr1, the chord center points Pb at the boss portion 2 and the chord center points Pt at the blade outer peripheral portion are located at the same positions, respectively, and a distance from the OX axis to the chord center point Pt at the blade outer peripheral portion is H.

Figure 14:
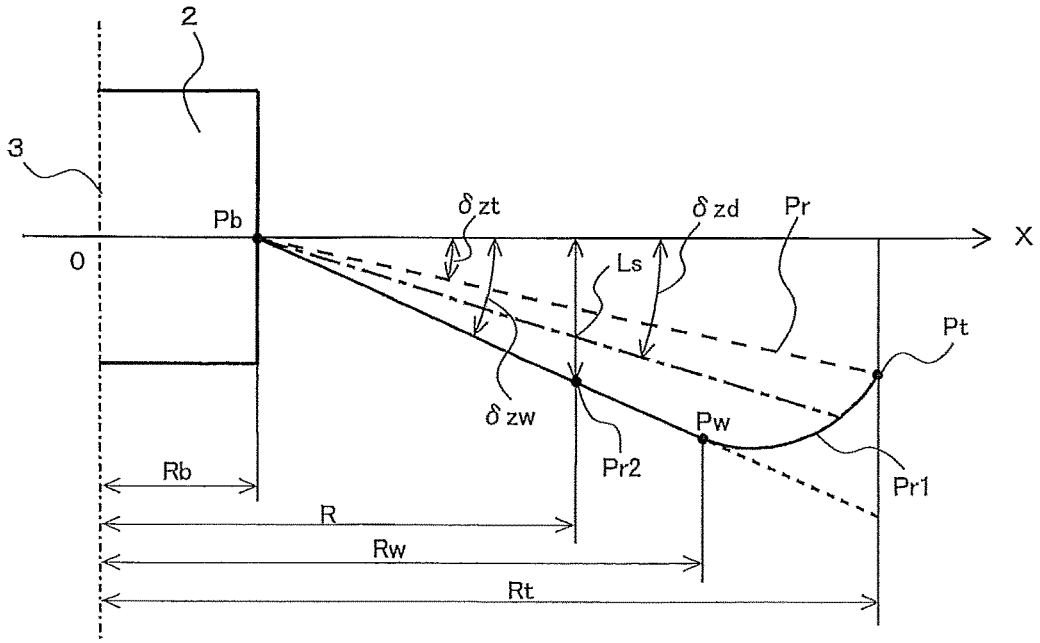
FIG. 14 is a view illustrating a method of defining the rotary blade illustrated in FIG. 12, in which the blade outer peripheral portion of the rotary blade is bent toward the upstream side in the flow direction.

FIG. 14 is a view for illustrating a method of defining the locus Pr1 of a chord center point Pr2 of the rotary blade 5*b* illustrated in FIG. 12. A chord center point at the arbitrary radius R from the rotation axis 3 is represented by Pr2, and a distance from the OX axis perpendicular to the rotation axis 3 to the chord center point Pr2 located on the chord center line Pr1 is represented by Ls.

In the rotary blade 5*b*, a first region in a range from the boss portion 2 (radius Rb) to a bending point Pw at an intermediate portion in the radial direction is inclined toward the downstream side at a constant first backward inclination angle δzw, and a second region in a range from the bending point Pw to the blade outer peripheral portion is inclined toward the upstream side with respect to the first region.

When a radius of the bending point Pw on the chord center line Pr1 is represented by Rw, and a second backward inclination angle corresponding to an angle of inclination toward the downstream side for a line Pr connecting the chord center point Pt at the blade outer peripheral portion and the chord center point Pb at the outer periphery of the boss portion 2 is represented by δzt, the first backward inclination angle δzw is expressed by the following expression.

$$\delta zw=\tan^{-1}(Ls/(R-Rb))$$

$$(Rb<R\leq Rw)$$

An inclination angle δzd corresponding to the chord center point Pr2 at the arbitrary radius R in the second region in the range from the bending point Pw to the blade outer peripheral portion (radius Rt) is set to be an n-th order function (1≤n) of the radius R as expressed below.

$$\delta zd=\alpha(R-Rw)^n+\delta zw$$

$$\alpha=(\delta zt-\delta zw)/(Rt-Rw)^n$$

$$(Rw<R\leq Rt)$$

Note that, the chord center line Pr1 in the second region may be inclined straight toward the upstream side at a constant forward inclination angle instead of setting the above-mentioned inclination angle δzd to be the n-th order function (1≤n) of the radius R.

In the rotary blade 5*b* defined in the above-mentioned manner under the state in which the outer peripheral portion of the rotary blade 5*b* is covered by the bellmouth 6, the respective parameters of the rotary blade 5*b* of this example are determined in the following manner, that is, δzt−δzw=+7.5 degrees, Rw=0.7Rt, and n=2. In this rotary blade 5*b*, reduction in noise by about −1 dB was verified experimentally as compared to the rotary blade 5 inclined backward at a constant angle.

INDUSTRIAL APPLICABILITY

As described above, the axial flow fan according to the present invention can be built into a ventilation fan, an outdoor unit of an air-conditioning apparatus, and other devices. In particular, the axial flow fan according to the present invention is suitable as an axial flow fan restricted in size of a device body and other factors.

REFERENCE SIGNS LIST

1 rotary blade 1' rotary blade projected on plane perpendicular to rotation axis 1*b'* blade leading-edge portion 1*c'* blade trailing-edge portion 1*d'* blade outer peripheral portion 2 boss portion 3 rotation axis 4 rotation direction 5, 5*a*, 5*b* rotary blade 6 bellmouth A direction of flow of air Pb, Pb' chord center point at boss portion Pt, Pt' chord center point at blade outer peripheral portion Pr, Pr' locus of chord center point (chord center line) Pr1 locus of chord center point (chord center line) Pr2 chord center point Pw bending point being starting point of change of constant inclination angle Sc plane perpendicular to rotation axis through chord center point at boss portion H distance from OX axis to chord center point Pt at blade outer peripheral portion δz1 backward inclination angle of rotary blade δz2 forward inclination angle of rotary blade δzw constant backward inclination angle of first region on inner side with respect to bending point Pw (first backward inclination angle) δzt inclination angle of line connecting chord center point Pb at boss portion and chord center point Pt at blade outer peripheral portion (second backward inclination angle) δzd inclination angle toward downstream side for line connecting chord center point Pr2 at arbitrary radius R in second region on outer side with respect to bending point Pw and chord center point PI at boss portion 7 bellmouth straight portion 7' bellmouth straight portion reduced in length 8 bellmouth suction-side round portion 9 bellmouth discharge-side round portion 10 product suction-side end surface 11 product discharge-side end surface 12 product outer shell portion 13 outer peripheral-side leading end portion of rotary blade B flow of air flowing into outer peripheral-side leading end portion along bellmouth 14 turbulence of flow of air B 15 motor Z1 distance between leading end portion of rotary blade and bellmouth suction-side round portion H height of outer peripheral portion of rotary blade L product height 17 outer peripheral-side trailing edge portion of rotary blade L' reduced product height

The invention claimed is:

1. An axial flow fan, comprising:

a boss portion rotationally driven by a motor;

a plurality of rotary blades each extending radially from a periphery of the boss portion and being configured to force air to flow in an airflow direction being a direction of a rotation axis of the motor; and a bellmouth accommodating the plurality of rotary blades, the bellmouth comprising a suction-side round portion being formed on a suction side of the bellmouth and having a curved surface expanded in a radial direction of the bellmouth and a discharge-side round portion being formed on a discharge side of the bellmouth and having a curved surface expanded in the radial direction of the bellmouth, the plurality of rotary blades each being inclined at a constant angle to have an outer peripheral portion of each of the plurality of rotary blades in a downstream side in an airflow direction, an entirety of the outer peripheral portion being located on the downstream side in the air flow direction with respect to the suction-side round portion, wherein a leading edge of the outer peripheral portion is located downstream of the suction-side round portion at a distance of between 4-10 mm in the airflow direction.

2. The axial flow fan of claim 1, wherein the entire outer peripheral portion of the each of the plurality of rotary blades is located on an upstream side of the flow of air to be blown with respect to the discharge-side round portion.

3. The axial flow fan of claim 1, wherein the suction-side round portion and the discharge-side round portion of the bellmouth are formed to be connected to each other by a straight portion having a smooth shape, and the straight portion is parallel to a rotation shaft of the motor.

4. The axial flow fan of claim 1, wherein the motor is arranged on the downstream side in the air flow direction with respect to the plurality of rotary blades.

5. The axial flow fan of claim 4, wherein the plurality of rotary blades and the motor are partially overlapped with each other in the direction of the rotation axis of the motor.

6. The axial flow fan of claim 1, wherein the outer peripheral portion of the each of the plurality of rotary blades is bent toward the suction side.

7. The axial flow fan of claim 1, wherein the entire rotary blade and the motor are accommodated in the bellmouth.

* * * * *